US008627663B2

(12) United States Patent
Ernst et al.

(10) Patent No.: US 8,627,663 B2
(45) Date of Patent: Jan. 14, 2014

(54) ENERGY RECOVERY SYSTEM AND METHOD USING AN ORGANIC RANKINE CYCLE WITH CONDENSER PRESSURE REGULATION

(75) Inventors: Timothy C. Ernst, Columbus, IN (US); Christopher R. Nelson, Columbus, IN (US); James A. Zigan, Versailles, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 833 days.

(21) Appl. No.: 12/552,725

(22) Filed: Sep. 2, 2009

(65) Prior Publication Data

US 2011/0048012 A1 Mar. 3, 2011

(51) Int. Cl.

| | |
|---|---|
| ***F01K 23/10*** | (2006.01) |
| ***F02G 3/00*** | (2006.01) |
| ***F01K 25/08*** | (2006.01) |
| ***F01K 25/00*** | (2006.01) |

(52) U.S. Cl.

USPC ..... 60/618; 60/616; 60/651; 60/671

(58) Field of Classification Search

USPC ..... 60/614–624, 645–681; 165/104.19–104.33, 280, 283, 285, 165/297, 299

See application file for complete search history.

(56) References Cited

U.S. PATENT DOCUMENTS

| | | | | |
|---|---|---|---|---|
| 3,232,052 | A | | 2/1966 | Ricard |
| 3,789,804 | A | | 2/1974 | Aguet |
| 4,009,587 | A | | 3/1977 | Robinson, Jr. et al. |
| 4,164,850 | A | | 8/1979 | Lowi, Jr. |
| 4,204,401 | A | | 5/1980 | Earnest |
| 4,232,522 | A | | 11/1980 | Steiger |
| 4,267,692 | A | | 5/1981 | Earnest |
| 4,271,664 | A | | 6/1981 | Earnest |
| 4,282,708 | A | | 8/1981 | Kuribayashi et al. |
| 4,425,762 | A | | 1/1984 | Wakamatsu et al. |
| 4,428,190 | A | | 1/1984 | Bronicki |
| 4,458,493 | A | | 7/1984 | Amir et al. |
| 4,471,622 | A | | 9/1984 | Kuwahara |
| 4,581,897 | A | | 4/1986 | Sankrithi |
| 4,630,572 | A | | 12/1986 | Evans |
| 4,831,817 | A | | 5/1989 | Linhardt |
| 4,873,829 | A | * | 10/1989 | Williamson ..... 60/670 |
| 4,911,110 | A | | 3/1990 | Isoda et al. |
| 5,121,607 | A | | 6/1992 | George, Jr. |
| 5,207,188 | A | | 5/1993 | Hama et al. |

(Continued)

FOREIGN PATENT DOCUMENTS

| | | |
|---|---|---|
| EP | 1 273 785 B1 | 5/2007 |
| JP | 60-222511 A | 11/1985 |

(Continued)

*Primary Examiner* — Kenneth Bomberg
*Assistant Examiner* — Christopher Jetton
(74) *Attorney, Agent, or Firm* — Foley & Lardner LLP

(57) ABSTRACT

An energy recovery system and method using an organic rankine cycle is provided for recovering waste heat from an internal combustion engine, which effectively controls condenser pressure to prevent unwanted cavitation within the fluid circulation pump. A coolant system may be provided with a bypass conduit around the condenser and a bypass valve selectively and variably controlling the flow of coolant to the condenser and the bypass. A subcooler may be provided integral with the receiver for immersion in the accumulated fluid or downstream of the receiver to effectively subcool the fluid near the inlet to the fluid pump.

19 Claims, 3 Drawing Sheets

(56) References Cited

U.S. PATENT DOCUMENTS

| | | | | |
|---|---|---|---|---|
| 5,421,157 | A | 6/1995 | Rosenblatt | |
| 5,649,513 | A | 7/1997 | Kanda | |
| 5,685,152 | A | 11/1997 | Sterling | |
| 5,771,868 | A | 6/1998 | Khair | |
| 5,806,322 | A | 9/1998 | Cakmakci et al. | |
| 5,915,472 | A | 6/1999 | Takikawa et al. | |
| 5,950,425 | A | 9/1999 | Takahashi et al. | |
| 6,014,856 | A | 1/2000 | Bronicki et al. | |
| 6,035,643 | A * | 3/2000 | Rosenblatt | 60/651 |
| 6,055,959 | A | 5/2000 | Taue | |
| 6,128,905 | A * | 10/2000 | Fahlsing | 60/661 |
| 6,138,649 | A | 10/2000 | Khair et al. | |
| 6,301,890 | B1 | 10/2001 | Zeretzke | |
| 6,321,697 | B1 | 11/2001 | Matsuda et al. | |
| 6,324,849 | B1 | 12/2001 | Togawa et al. | |
| 6,393,840 | B1 | 5/2002 | Hay | |
| 6,494,045 | B2 | 12/2002 | Rollins, III | |
| 6,523,349 | B2 | 2/2003 | Viteri | |
| 6,571,548 | B1 | 6/2003 | Bronicki et al. | |
| 6,598,397 | B2 | 7/2003 | Hanna et al. | |
| 6,606,848 | B1 | 8/2003 | Rollins, III | |
| 6,637,207 | B2 | 10/2003 | Konezciny et al. | |
| 6,701,712 | B2 | 3/2004 | Bronicki et al. | |
| 6,715,296 | B2 | 4/2004 | Bakran et al. | |
| 6,745,574 | B1 | 6/2004 | Dettmer | |
| 6,748,934 | B2 | 6/2004 | Natkin et al. | |
| 6,751,959 | B1 | 6/2004 | McClanahan | |
| 6,792,756 | B2 | 9/2004 | Bakran et al. | |
| 6,810,668 | B2 | 11/2004 | Nagatani et al. | |
| 6,817,185 | B2 | 11/2004 | Coney et al. | |
| 6,848,259 | B2 | 2/2005 | Keller-Sornig et al. | |
| 6,877,323 | B2 | 4/2005 | Dewis | |
| 6,880,344 | B2 | 4/2005 | Radcliff et al. | |
| 6,910,333 | B2 | 6/2005 | Minemi et al. | |
| 6,964,168 | B1 | 11/2005 | Pierson et al. | |
| 6,977,983 | B2 | 12/2005 | Correia et al. | |
| 6,986,251 | B2 | 1/2006 | Radcliff et al. | |
| 7,007,487 | B2 | 3/2006 | Belokon et al. | |
| 7,028,463 | B2 | 4/2006 | Hammond et al. | |
| 7,044,210 | B2 | 5/2006 | Usui | |
| 7,069,884 | B2 | 7/2006 | Baba et al. | |
| 7,117,827 | B1 | 10/2006 | Hinderks | |
| 7,121,906 | B2 | 10/2006 | Sundel | |
| 7,131,259 | B2 | 11/2006 | Rollins, III | |
| 7,131,290 | B2 | 11/2006 | Taniguchi et al. | |
| 7,159,400 | B2 | 1/2007 | Tsutsui et al. | |
| 7,174,716 | B2 | 2/2007 | Brasz et al. | |
| 7,174,732 | B2 | 2/2007 | Taniguchi et al. | |
| 7,191,740 | B2 | 3/2007 | Baba et al. | |
| 7,200,996 | B2 * | 4/2007 | Cogswell et al. | 60/651 |
| 7,225,621 | B2 | 6/2007 | Zimron et al. | |
| 7,281,530 | B2 | 10/2007 | Usui | |
| 7,325,401 | B1 | 2/2008 | Kesseli et al. | |
| 7,340,897 | B2 * | 3/2008 | Zimron et al. | 60/641.1 |
| 7,454,911 | B2 | 11/2008 | Tafas | |
| 7,469,540 | B1 | 12/2008 | Knapton et al. | |
| 7,578,139 | B2 | 8/2009 | Nishikawa et al. | |
| 7,665,304 | B2 | 2/2010 | Sundel | |
| 7,721,552 | B2 | 5/2010 | Hansson et al. | |
| 7,797,940 | B2 | 9/2010 | Kaplan | |
| 7,823,381 | B2 | 11/2010 | Misselhorn | |
| 7,833,433 | B2 | 11/2010 | Singh et al. | |
| 7,866,157 | B2 | 1/2011 | Ernst et al. | |
| 7,942,001 | B2 | 5/2011 | Radcliff et al. | |
| 7,958,873 | B2 | 6/2011 | Ernst et al. | |
| 7,997,076 | B2 | 8/2011 | Ernst | |
| 8,302,399 | B1 | 11/2012 | Freund et al. | |
| 2002/0099476 | A1 | 7/2002 | Hamrin et al. | |
| 2003/0033812 | A1 | 2/2003 | Gerdes et al. | |
| 2003/0213245 | A1 | 11/2003 | Yates et al. | |
| 2003/0213246 | A1 | 11/2003 | Coll et al. | |
| 2003/0213248 | A1 | 11/2003 | Osborne et al. | |
| 2005/0262842 | A1 | 12/2005 | Claassen et al. | |
| 2008/0163625 | A1 | 7/2008 | O'Brien | |
| 2008/0289313 | A1 | 11/2008 | Batscha et al. | |
| 2009/0031724 | A1 | 2/2009 | Ruiz | |
| 2009/0071156 | A1 | 3/2009 | Nishikawa et al. | |
| 2009/0090109 | A1 | 4/2009 | Mills et al. | |
| 2009/0121495 | A1 | 5/2009 | Mills | |
| 2009/0133646 | A1 | 5/2009 | Wankhede et al. | |
| 2009/0151356 | A1 | 6/2009 | Ast et al. | |
| 2009/0179429 | A1 | 7/2009 | Ellis et al. | |
| 2009/0211253 | A1 | 8/2009 | Radcliff et al. | |
| 2009/0320477 | A1 | 12/2009 | Juchymenko | |
| 2009/0322089 | A1 | 12/2009 | Mills et al. | |
| 2010/0018207 | A1 | 1/2010 | Juchymenko | |
| 2010/0071368 | A1 | 3/2010 | Kaplan et al. | |
| 2010/0083919 | A1 | 4/2010 | Bucknell | |
| 2010/0139626 | A1 | 6/2010 | Raab et al. | |
| 2010/0156112 | A1 | 6/2010 | Held et al. | |
| 2010/0180584 | A1 | 7/2010 | Berger et al. | |
| 2010/0186410 | A1 | 7/2010 | Cogswell et al. | |
| 2010/0192569 | A1 | 8/2010 | Ambros et al. | |
| 2010/0229525 | A1 | 9/2010 | Mackay et al. | |
| 2010/0257858 | A1 | 10/2010 | Yaguchi et al. | |
| 2010/0263380 | A1 | 10/2010 | Biederman et al. | |
| 2010/0282221 | A1 | 11/2010 | Le Lievre | |
| 2010/0288571 | A1 | 11/2010 | Dewis et al. | |
| 2010/0300093 | A1 | 12/2010 | Doty | |
| 2011/0005477 | A1 | 1/2011 | Terashima et al. | |
| 2011/0006523 | A1 | 1/2011 | Samuel | |
| 2011/0094485 | A1 | 4/2011 | Vuk et al. | |
| 2011/0203278 | A1 | 8/2011 | Kopecek et al. | |
| 2011/0209473 | A1 | 9/2011 | Fritz et al. | |
| 2012/0023946 | A1 | 2/2012 | Ernst et al. | |

FOREIGN PATENT DOCUMENTS

| | | | |
|---|---|---|---|
| JP | 8-68318 | A | 3/1996 |
| JP | 9-32653 | A | 2/1997 |
| JP | 10-238418 | A | 9/1998 |
| JP | 11-166453 | A | 6/1999 |
| JP | 2005-36787 | A | 2/2005 |
| JP | 2005-42618 | A | 2/2005 |
| JP | 2005-201067 | A | 7/2005 |
| JP | 2005-329843 | A | 12/2005 |
| JP | 2008-240613 | A | 10/2008 |
| JP | 2009-167995 | A | 7/2009 |
| JP | 2009-191647 | A | 8/2009 |
| JP | 2010-77964 | A | 4/2010 |
| WO | 2009/098471 | A2 | 8/2009 |

* cited by examiner

ENERGY RECOVERY SYSTEM AND METHOD USING AN ORGANIC RANKINE CYCLE WITH CONDENSER PRESSURE REGULATION

FIELD OF THE INVENTION

The present invention generally relates to energy recovery from the waste heat of a prime mover machine such as an internal combustion engine.

BACKGROUND OF THE INVENTION

It is well known that the thermal efficiency of an internal combustion engine is very low. The energy not extracted as usable mechanical energy is typically expelled as waste heat into the atmosphere by way of the engine's exhaust gas emission, charge air cooling and engine coolant heat rejection.

It is known to employ a relatively simple, closed-loop Organic Rankine Cycle (ORC) system to recapture the engine's waste heat otherwise lost to the surrounding ambient. Such a system typically comprises a circulating pump, pumping a liquid phase organic, working fluid through a boiler wherein the working fluid undergoes a phase change from a liquid to a pressurized, gaseous phase. The boiler receives its heat input from the engine's waste heat streams. The gaseous phase working fluid expands through a turbine wherein mechanical work is extracted from the turbine. A low pressure vapor, typically exiting the turbine, then enters a condenser intended to cool and return the two phase fluid to a saturated liquid phase for recirculation by the circulating pump. A receiver is typically placed between the condenser and the recirculation pump to accumulate and separate the liquid portion of the fluid from any surviving gaseous phase exiting the condenser. The fluid passing through the condenser is typically cooled by a suitable cooling medium directed through the condenser. However, improvements are desirable.

SUMMARY OF THE INVENTION

The present invention achieves various functions and advantages as described herein and includes a system and method of recovering energy from a source of waste heat using an organic fluid, comprising providing a waste heat source, providing a heat exchanger, passing a heat conveying medium from said waste heat source through the heat exchanger, providing a fluid pump to pressurize the organic fluid, and passing the pressurized organic fluid through the heat exchanger. The system and method further include directing the organic fluid from the heat exchanger through an energy conversion device, passing the organic fluid from the turbine through a cooling condenser, directing the organic fluid from the condenser into and through a receiver, returning the organic fluid from the receiver to said pump, providing a condenser coolant fluid flow through the condenser to cool the organic fluid flowing through the condenser, and selectively bypassing coolant flow around the condenser.

The system and method may further include selectively varying the bypassed coolant flow based on at least one of a temperature and a pressure of the organic fluid upstream of the fluid pump, and further may be based on a saturation pressure of the organic fluid near an inlet of the fluid pump. A subcooler may be positioned within the receiver so as to be immersed in the organic fluid accumulated in the receiver. A subcooler may be provided downstream of the receiver and upstream of the fluid pump. A bypass valve may be positioned upstream of the condenser along a coolant flow circuit to selectively bypass coolant flow around the condenser. The method and system may also include measuring an inlet temperature of the organic fluid entering the fluid pump, measuring an inlet pressure of the organic fluid entering the organic fluid pump, determining a saturation pressure corresponding to the measured inlet temperature, comparing said measured inlet pressure to the saturation pressure, and increasing the bypass flow of coolant around the condenser thereby decreasing the flow of coolant through the condenser when the measured inlet pressure of the organic fluid is not greater than the saturation pressure plus a specified delta pressure.

The present invention is also directed to a system of recovering energy from a source of waste heat using an organic fluid, comprising an organic fluid circuit, a heat exchanger arranged along the organic fluid circuit to receive a heat conveying medium and the organic fluid, an energy conversion device positioned to receive organic fluid from the heat exchanger, a cooling condenser positioned to receive the organic fluid from the heat exchanger, a receiver positioned downstream of the cooling condenser to receive the organic fluid, a pump to receive organic fluid from the receiver and direct the organic fluid through the heat exchanger, a coolant circuit to direct coolant through the cooling condenser, and a subcooler positioned along the coolant circuit upstream of the condenser. The subcooler is positioned along the organic fluid circuit downstream of the receiver and upstream of the pump to cool the organic fluid flowing from the receiver prior to entering the pump.

DETAILED DESCRIPTION OF THE INVENTION

Applicants have recognized that during large transient heat inputs from the waste heat or abrupt changes in the temperature of the coolant flowing through the condenser, a rapid condenser pressure decrease may occur causing the fluid in the receiver to boil. As a result, the circulation pump, in the ORC, may undesirably experience cavitation. Applicant has recognized that measures can be taken to assure that sufficient fluid pressure is maintained thereby preventing pump cavitation.

Figure 1:
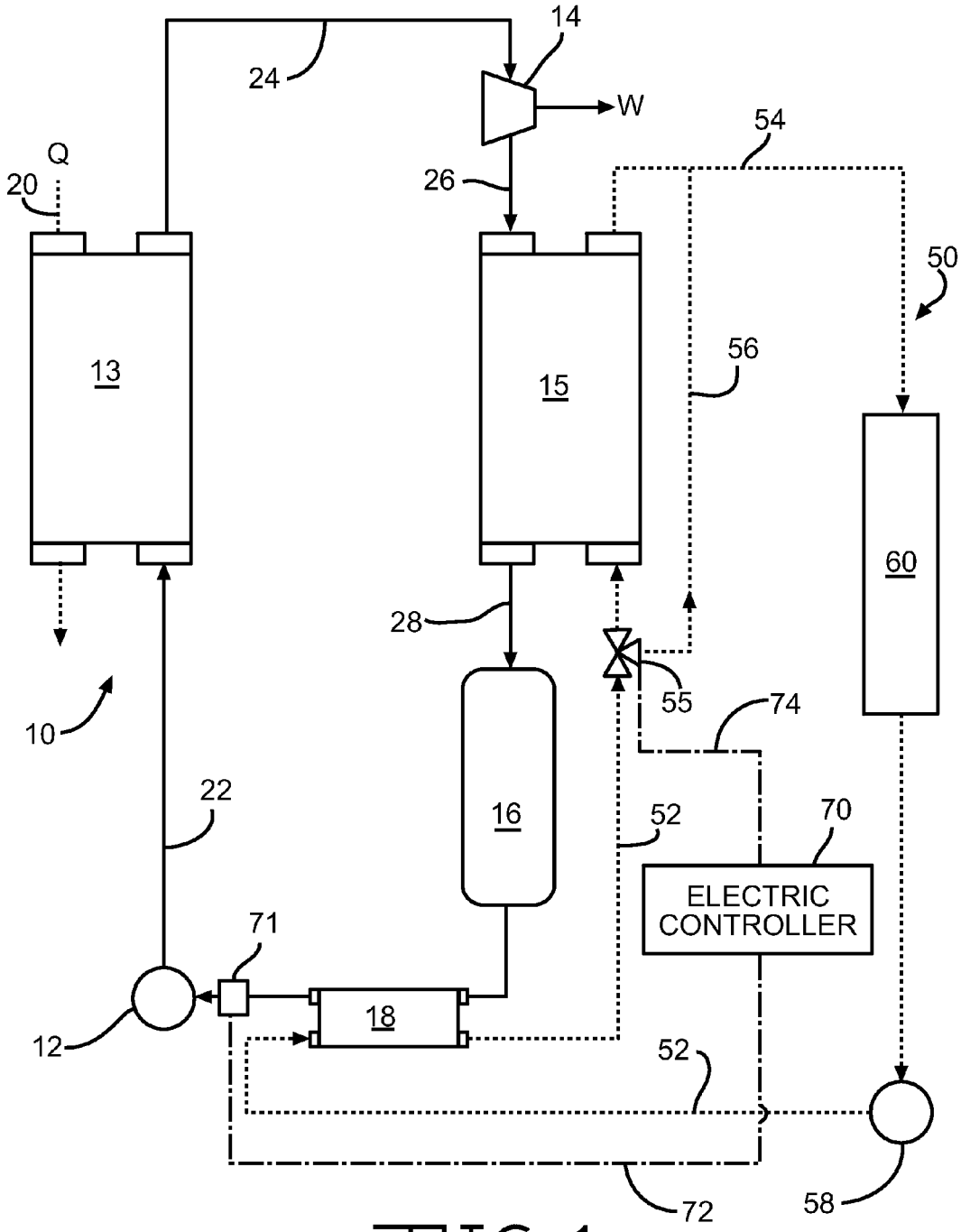
FIG. 1 schematically illustrates one exemplary embodiment of a waste heat recovery system of the present invention.

In particular, FIG. 1 presents a schematic of a closed loop Organic Rankine Cycle (ORC) system 10 in accordance with an exemplary embodiment of the present invention which addresses the aforementioned issue. The ORC system 10 includes a circulating pump 12 for circulating a liquid phase organic fluid, such as R-245fa, or any other suitable refrigerant, through an organic fluid circuit including conduits 22, 24, 26, and 28. A heat exchanger or boiler 13, positioned downstream of pump 12, receives a high temperature heat conveying medium 20, such as high temperature exhaust gas, from a waste heat source Q, such as an internal combustion engine, and transfers the waste heat to the organic fluid causing the organic fluid to change from a liquid phase fluid to a high pressure gaseous phase.

The gaseous phase fluid flows from boiler 13 through conduit 24 to an energy conversion device such as turbine 14. The gaseous fluid expands through turbine 14 creating mechanical work W at the turbine shaft. An expanded, low pressure vapor generally exits turbine 14 through passage 26 and is directed through a condenser 15 wherein the vapor returns to its liquid phase by the cooling effect of the coolant flowing through condenser 15. The resulting re-liquefied or condensed fluid exits condenser 15 and is conveyed through a conduit 28 to a receiver 16 for accumulating a sufficient supply of organic fluid for supplying pump 12 and for recirculation through the system 10. However, the present embodiment also includes a subcooler 18 positioned along conduit 28 downstream of receiver 16 and upstream of pump 12. The re-liquefied fluid within conduit 28 is thus further cooled below the fluid's saturation temperature by flowing through subcooler 18 prior to entering the intake port of re-circulation pump 12.

ORC system 10 further includes a separate closed loop condenser coolant system 50 whereby a suitable coolant is circulated through coolant system 50 including a coolant circuit including conduits 52 and 54. Coolant system 50 includes subcooler 18 and a coolant pump 58, positioned along conduit 52, to circulate the coolant through subcooler 18, wherein excess heat is removed from the re-liquefied fluid passing through conduit 28 prior to entering the intake port of pump 12 thereby reducing the temperature of the organic fluid.

During normal operation, the coolant passing through conduit 52 flows from subcooler 18 through condenser 15 thereby causing condensation of the two-phase organic fluid passing through condenser 15 by extracting heat from the two-phase fluid. The heated coolant exiting condenser 15 through conduit 54 is then passed through radiator 60 where the coolant is re-cooled to a desired working temperature by, for example, air flow, for recycling through coolant system 50 by coolant pump 58.

Coolant system 50 of ORC system 10 also includes a bypass valve 55 positioned along conduit 52 to control the coolant flow to condenser 15 and a bypass conduit 56. Bypass valve 55 is connected to conduit 56 which functions as a bypass passage directing flow around, i.e. in parallel with, the condenser 15 by connecting conduit 52 to conduit 54. Bypass valve 55 is preferably adjustable to selectively vary the quantity of the coolant flow through condenser 15 and thus vary the quantity of coolant flow through bypass conduit 56 as desired. For example, bypass valve 55 may be a variable position three-way valve capable of completely blocking flow to condenser 15 while permitting bypass flow, completely blocking flow to the bypass conduit 56 while allowing flow to the condenser, or allowing a portion of coolant flow through the condenser and a portion of coolant flow through bypass conduit 56 simultaneously. Bypass valve 55 preferably is capable of modulating or variably controlling the quantity of coolant flow through the condenser 15 and bypass conduit 56 based on operating conditions to ensure appropriate condenser pressure to prevent boiling of the working organic fluid and thus prevent cavitation at pump 12 through operation at various operating conditions.

During operation, if the pressure in condenser 15 decreases, for example, because of transients or changes in engine load or coolant temperature, bypass valve 55 is programmed to close-off or block, all or a portion of the coolant flow to condenser 15 and direct all or an increased portion of coolant through conduit 56 around condenser 15 directly to radiator 60. Thus the pressure within condenser 15 may be controlled, thereby preventing boiling within receiver 16 caused by an accompanying pressure drop. It should be noted that such transients may include, for example, the engine of waste heat source Q changing from a high load to a low load condition thus rapidly decreasing the heat input to the ORC system causing less heat to be rejected in the condenser resulting in a pressure decrease. Also, a coolant temperature decrease, causing a sudden condenser pressure drop, may be initiated by a sudden decrease in the temperature of the, for example, air flow through radiator 60.

Figure 2:
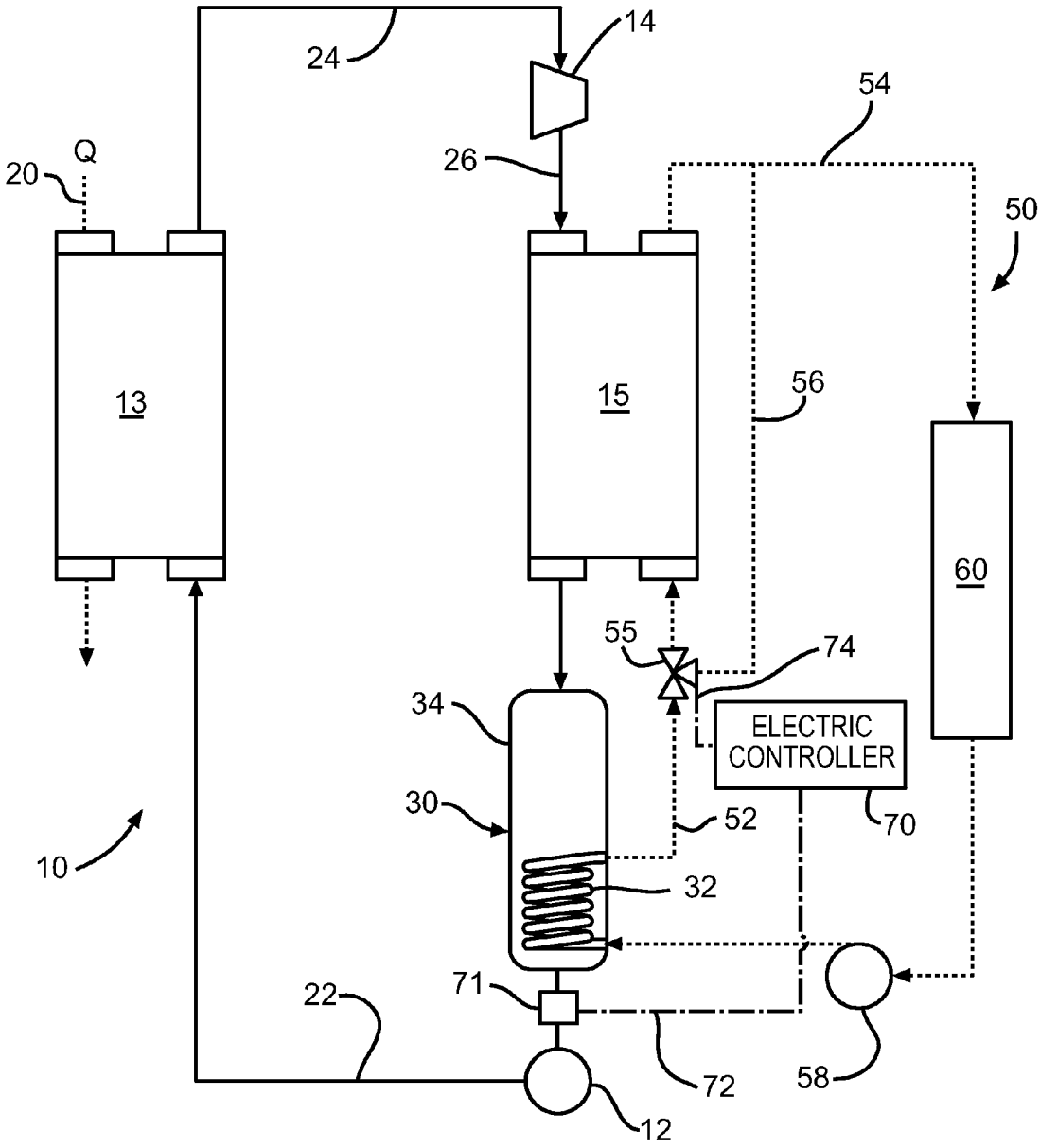
FIG. 2 presents another exemplary embodiment of a waste heat recovery system of the present invention.

FIG. 2 presents a schematic of an alternate embodiment of the waste heat recovery system illustrated in FIG. 1. The primary difference between the FIG. 1 embodiment and that of FIG. 2 is that receiver 16 and subcooler 18, of the FIG. 1 embodiment, has been replaced by an integrated receiver/subcooler 30 wherein a coolant subcooler coil 32 is integral to the receiver 34. Thus subcooler 32 is immersed in the organic fluid accumulating in receiver 34. The functioning of all components remains the same as the embodiment of FIG. 1.

Figure 3:
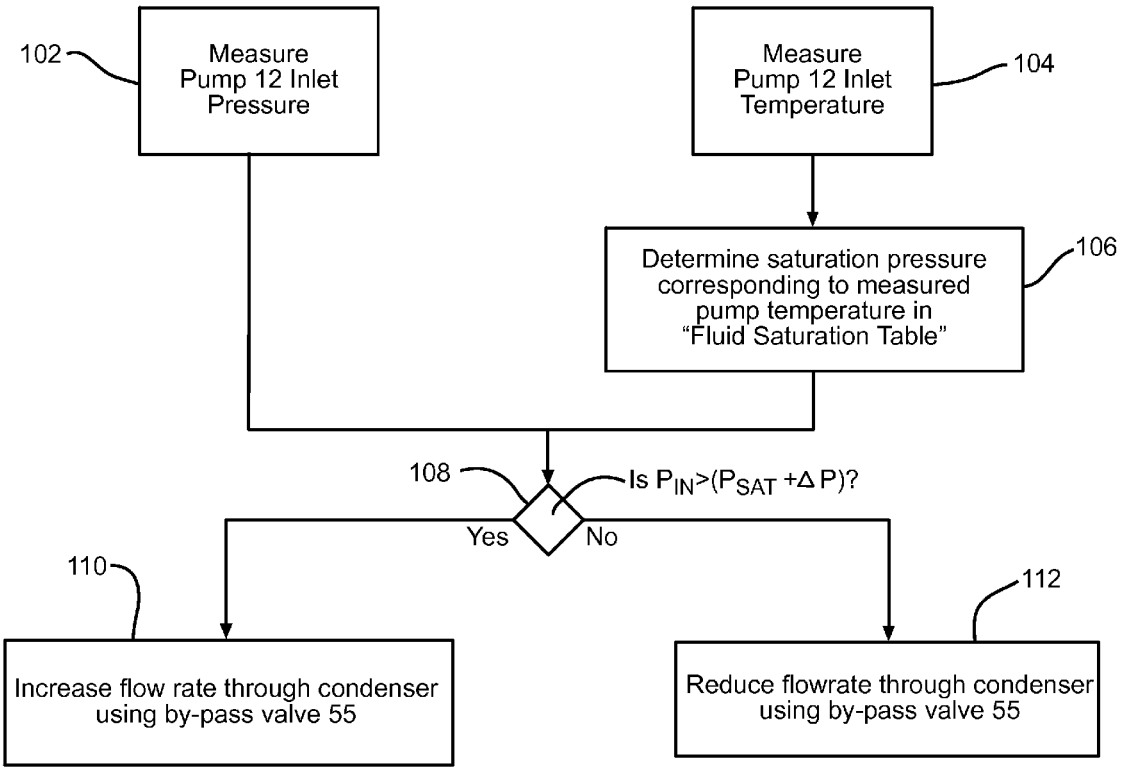
FIG. 3 presents a flow chart illustrating an exemplary method of the present invention for controlling the condenser coolant bypass valve.

Turning now to FIG. 3, a simplified flow chart is illustrated for controlling the flow of condenser coolant through conduit 52, condenser 15, bypass valve 55 and bypass loop conduit 56. During normal, steady state, operating conditions bypass valve 55 is in a first position permitting all of the condenser coolant to flow through condenser 15 while blocking flow through bypass conduit 56. In steps 102 and 104, a control system monitors and detects or measures the inlet pressure 102 (P.sub.in) and inlet temperature, respectively, of the organic fluid at the inlet to pump 12 using appropriate sensors 71, an electronic controller 70, and an appropriate signal connection 72 between the sensors and the electronic controller 70. In step 106, using the inlet pressure and temperature of the organic fluid at or near the inlet of pump 12, electronic controller 70 determines the corresponding saturation pressure P.sub.sat using an appropriate known look-up table, such as a fluid saturation table, for the particular organic fluid used in the system 10. The measured pump inlet pressure P.sub.in is compared in step 108 to the fluid saturation pressure P.sub.sat plus a predetermined cavitation margin AP appropriate for the given system. The net inlet pressure requirement (or cavitation margin) is the excess pressure above the fluids saturation pressure for the given inlet temperature. Each pump has it's own unique net inlet pressure requirement to prevent the pump from cavitating based on the pump style and geometry. If the inlet pressure to the pump is not at or above the net inlet pressure requirement, it will cavitate and may cause pump damage or loss of the ability to pump fluid. If P.sub.in is greater than P.sub.sat plus .DELTA.P, then in step 110, the flow rate of coolant through the condenser is increased thereby providing increased cooling of the organic fluid in the condenser while decreasing coolant flow through bypass conduit 56. However, if P.sub.in is less than P.sub.sat plus .DELTA.P, then in step 112, controller 70 controls bypass valve 55 toward a second position to increase the valve opening to conduit 56 to provide more bypass flow around condenser 15 while reducing the valve opening to conduit 52 to decrease the flow rate of coolant to condenser 15. Coolant flow through the condenser is slowly increased, or decreased, as dictated by the subcooling requirement. That is, electronic controller 70 determines and applies the margin, compares the pressures, and generates and sends a control signal via control connector 74 to bypass valve 55 to selectively and variably adjust the position of bypass valve 55 to variably control the flow of coolant through condenser 15 and bypass conduit 56 to achieve the desired effect.

Thus by variable operation of bypass valve 55, the system 50 bypasses coolant flow around condenser 15 as needed as dictated by working fluid subcooling level. The system may also include a subcooler, either integrated in the receiver or positioned downstream of the receiver, to subcool the working fluid prior to the working fluid entering the circulation pump intake port to assist in cooling the working fluid to a temperature sufficiently below the working fluid's boiling temperature for a given system pressure thereby maintaining the fluid in a liquid state. As a result, the pressure within the condenser, and thus the receiver, may be controlled, i.e., maintained at a sufficiently elevated level, to prevent unwanted boiling within receiver 16 and cavitation at pump 12.

While we have described above the principles of our invention in connection with a specific embodiment, it is to be clearly understood that this description is made only by way of example and not as a limitation of the scope of our invention as set forth in the accompanying claims.

I claim:

1. A method of recovering energy from a source of waste heat using an organic fluid, comprising:

providing a waste heat source;

providing a heat exchanger;

passing a heat conveying medium from said waste heat source through said heat exchanger;

providing a fluid pump to pressurize the organic fluid;

passing said pressurized organic fluid through said heat exchanger;

directing said organic fluid from said heat exchanger through an energy conversion device;

passing the organic fluid from said energy conversion device through a cooling condenser;

directing said organic fluid from said condenser into and through a receiver;

returning said organic fluid from said receiver to said pump;

providing a condenser coolant fluid flow through said condenser to cool the organic fluid flowing through said condenser; and selectively bypassing coolant flow around said condenser, wherein said bypassing of coolant flow is selectively varied based on at least one of a temperature and a pressure of the organic fluid upstream of said fluid pump, wherein said pressure of the organic fluid upstream of said fluid pump is a saturation pressure of the organic fluid near an inlet of said fluid pump.

2. A method of recovering energy from a source of waste heat using an organic fluid, comprising:

providing a waste heat source;

providing a heat exchanger;

passing a heat conveying medium from said waste heat source through said heat exchanger;

providing a fluid pump to pressurize the organic fluid;

passing said pressurized organic fluid through said heat exchanger;

directing said organic fluid from said heat exchanger through an energy conversion device;

passing the organic fluid from said energy conversion device through a cooling condenser;

directing said organic fluid from said condenser into and through a receiver;

returning said organic fluid from said receiver to said pump;

providing a condenser coolant fluid flow through said condenser to cool the organic fluid flowing through said condenser;

selectively bypassing coolant flow around said condenser; and providing a subcooler positioned within said receiver so as to be immersed in the organic fluid accumulated in said receiver.

3. A method of recovering energy from a source of waste heat using an organic fluid, comprising:

providing a waste heat source;

providing a heat exchanger;

passing a heat conveying medium from said waste heat source through said heat exchanger;

providing a fluid pump to pressurize the organic fluid;

passing said pressurized organic fluid through said heat exchanger;

directing said organic fluid from said heat exchanger through an energy conversion device;

passing the organic fluid from said energy conversion device through a cooling condenser;

directing said organic fluid from said condenser into and through a receiver;

returning said organic fluid from said receiver to said pump;

providing a condenser coolant fluid flow through said condenser to cool the organic fluid flowing through said condenser;

selectively bypassing coolant flow around said condenser; and providing a subcooler downstream of said receiver and upstream of said fluid pump.

4. A method of recovering energy from a source of waste heat using an organic fluid, comprising:

providing a waste heat source;

providing a heat exchanger;

passing a heat conveying medium from said waste heat source through said heat exchanger;

providing a fluid pump to pressurize the organic fluid;

passing said pressurized organic fluid through said heat exchanger;

directing said organic fluid from said heat exchanger through an energy conversion device;

passing the organic fluid from said energy conversion device through a cooling condenser;

directing said organic fluid from said condenser into and through a receiver;

returning said organic fluid from said receiver to said pump;

providing a condenser coolant fluid flow through said condenser to cool the organic fluid flowing through said condenser;

selectively bypassing coolant flow around said condenser;

measuring said temperature of the organic fluid at an inlet temperature of the organic fluid entering said fluid pump;

measuring said pressure of the organic fluid at an inlet pressure of the organic fluid entering said fluid pump;

determining a saturation pressure corresponding to said measured inlet temperature;

comparing said measured inlet pressure to said saturation pressure; and increasing the bypass flow of coolant around the condenser thereby decreasing the flow of coolant through said condenser when said measured inlet pressure of said organic fluid is not greater than said saturation pressure plus a specified delta pressure, wherein said bypassing of coolant flow is selectively varied based on at least one of a temperature and a pressure of the organic fluid upstream of said fluid pump.

5. A system of recovering energy from a source of waste heat using an organic fluid, comprising:

a heat exchanger arranged to receive a heat conveying medium and the organic fluid;

an energy conversion device positioned to receive organic fluid from said heat exchanger;

a cooling condenser positioned to receive the organic fluid from said heat exchanger;

a pump for pressuring the organic fluid to direct the organic fluid through said heat exchanger and said cooling condenser;

a receiver positioned downstream of said cooling condenser to receive the organic fluid;

a coolant circuit to direct coolant through said cooling condenser; and a bypass valve positioned along said coolant circuit upstream of said cooling condenser to selectively bypass coolant flow around said cooling condenser; and a subcooler positioned within said receiver so as to be immersed in the organic fluid accumulated in said receiver.

6. The system of claim 5, wherein said subcooler is positioned along the coolant circuit upstream of the bypass valve.

7. The system of claim 5, wherein said subcooler is positioned to receive an entire flow of coolant in the coolant circuit throughout operation of the bypass valve.

8. The system of claim 5, further including a sensor adapted to detect said at least one of temperature and pressure and generate a corresponding signal, and a controller adapted to receive said corresponding signal from said sensor and generate a control signal based on said corresponding signal to control said bypass valve.

9. A system of recovering energy from a source of waste heat using an organic fluid, comprising:

a heat exchanger arranged to receive a heat conveying medium and the organic fluid;

an energy conversion device positioned to receive organic fluid from said heat exchanger;

a cooling condenser positioned to receive the organic fluid from said heat exchanger;

a pump for pressuring the organic fluid to direct the organic fluid through said heat exchanger and said cooling condenser;

a receiver positioned downstream of said cooling condenser to receive the organic fluid;

a coolant circuit to direct coolant through said cooling condenser;

a bypass valve positioned along said coolant circuit upstream of said cooling condenser to selectively bypass coolant flow around said cooling condenser; and a subcooler positioned downstream of said receiver and upstream of said pump.

10. The system of claim 9, wherein said subcooler is positioned along the coolant circuit upstream of the bypass valve.

11. The system of claim 9, wherein said subcooler is positioned to receive an entire flow of coolant in the coolant circuit throughout operation of the bypass valve.

12. The system of claim 9, further including a sensor adapted to detect said at least one of temperature and pressure and generate a corresponding signal, and a controller adapted to receive said corresponding signal from said sensor and generate a control signal based on said corresponding signal to control said bypass valve.

13. A system of recovering energy from a source of waste heat using an organic fluid, comprising:

a heat exchanger arranged to receive a heat conveying medium and the organic fluid;

an energy conversion device positioned to receive organic fluid from said heat exchanger;

a cooling condenser positioned to receive the organic fluid from said heat exchanger;

a pump for pressuring the organic fluid to direct the organic fluid through said heat exchanger and said cooling condenser;

a receiver positioned downstream of said cooling condenser to receive the organic fluid;

a coolant circuit to direct coolant through said cooling condenser; and a bypass valve positioned along said coolant circuit upstream of said cooling condenser to selectively bypass coolant flow around said cooling condenser, wherein said bypass valve selectively and variably controls the flow of coolant through said cooling condenser based on at least one of a temperature and a pressure of the organic fluid upstream of said pump, wherein said temperature of the upstream of said pump is an inlet temperature of the organic fluid entering the pump and said pressure of the organic fluid upstream of said pump is an inlet pressure of the organic fluid entering said pump, and further including a control means adapted to measure the inlet temperature of the organic fluid entering said pump, measure the inlet pressure of the organic fluid entering said pump, determine a saturation pressure corresponding to said measured inlet temperature, compare said measured inlet pressure to said saturation pressure, and increase the bypass flow of coolant around the condenser thereby decreasing the flow of coolant through said condenser when said measured inlet pressure of said organic fluid is not greater than said saturation pressure plus a specified delta pressure.

14. A system of recovering energy from a source of waste heat using an organic fluid, comprising:

an organic fluid circuit;

a heat exchanger arranged along the organic fluid circuit to receive a heat conveying medium and the organic fluid;

an energy conversion device positioned to receive organic fluid from said heat exchanger;

a cooling condenser positioned to receive the organic fluid from said heat exchanger;

a receiver positioned downstream of said cooling condenser to receive the organic fluid;

a pump to receive organic fluid from said receiver and direct the organic fluid through said heat exchanger;

a coolant circuit to direct coolant through said cooling condenser;

a subcooler positioned along said coolant circuit upstream of said condenser, said subcooler positioned along said organic fluid circuit downstream of said receiver and upstream of said pump to cool the organic fluid flowing from said receiver prior to entering said pump; and a bypass valve positioned along said coolant circuit upstream of said cooling condenser to selectively bypass coolant flow around said cooling condenser.

15. The system of claim 14, wherein said bypass valve selectively and variably controls the flow of coolant through said cooling condenser based on at least one of a temperature and a pressure of the organic fluid upstream of said pump.

16. The system of claim 14, wherein said bypass valve selectively and variably controls the flow of coolant through said cooling condenser based on a saturation pressure of the organic fluid near an inlet of said fluid pump.

17. The system of claim 14, wherein said subcooler is positioned along the coolant circuit upstream of the bypass valve.

18. The system of claim 14, wherein said subcooler is positioned to receive an entire flow of coolant in the coolant circuit throughout operation of the bypass valve.

19. The system of claim 14, further including a sensor adapted to detect said at least one of temperature and pressure and generate a corresponding signal, and a controller adapted to receive said corresponding signal from said sensor and generate a control signal based on said corresponding signal to control said bypass valve.

* * * * *